US006016661A

United States Patent [19]

Sagar

[11] Patent Number: 6,016,661

[45] Date of Patent: Jan. 25, 2000

[54] REFRIGERANT RECOVERY SYSTEM

[76] Inventor: Christopher L. Sagar, 7534 42nd Ct. E., Sarasota, Fla. 34324

[21] Appl. No.: 08/953,869

[22] Filed: Oct. 18, 1997

[51] Int. Cl.[7] ..... F25B 45/00

[52] U.S. Cl. ..... 62/149; 62/292

[58] Field of Search ..... 62/149, 292, 77, 62/195

[56] References Cited

U.S. PATENT DOCUMENTS 5,363,662 11/1994 Todack ..... 62/149

5,560,215 10/1996 Talarico ..... 62/149

*Primary Examiner*—John M. Sollecito

*Attorney, Agent, or Firm*—A. W. Fisher, III

[57] ABSTRACT

A refrigerant recovery system for use in combination with a low pressure recovery reservoir to recover refrigerants such as CFC, HCFC and HFC from a air conditioning or refrigeration system selectively operable in a plurality of system operating modes including a pressurization mode, a liquid refrigerant recovery mode and a vapor refrigerant recovery mode comprising a system control including a microprocessor to control the operation of the refrigerant recovery system and a plurality of control sensors to monitor a corresponding plurality of system operating parameters, a refrigerant processor operatively coupled to the low pressure recovery tank and the air conditioning or refrigeration system by a fluid conduit network including a plurality of fluid conduits and a fluid flow control including a plurality of fluid flow control devices coupled to the microprocessor to receive control signals therefrom and operatively disposed relative to the fluid conduit network to selectively configure the fluid conduit network to control the flow of the refrigerant therethrough in a plurality of operating configurations corresponding to the plurality of system operating modes in response to the state of the plurality of system operating parameters sensed by the plurality of control sensors to transfer refrigerant from the air conditioning or refrigeration system to the low pressure recovery reservoir.

8 Claims, 4 Drawing Sheets

REFRIGERANT RECOVERY SYSTEM

BACKGROUND OF THE INVENTION

1. Field of the Invention

A refrigerant recovery system for use in combination with a low pressure recovery reservoir to recover refrigerants such as CFC, HCFC and HFC.

2. Description of the Prior Art

Numerous efforts have been made to design and configure systems to recover refrigerants from refrigeration and air conditioning systems.

U.S. Pat. No. 5,617,731 teaches a refrigerant recovery/recyclying apparatus including a primary vapor-type filter/dryer to receive recovered vapor refrigerant with isolation valves upstream and downstream thereof so as to allow replacement of the cores. To prevent excessive inlet pressures to the compressor of the recovery apparatus, a crankcase pressure regulator is provided upstream of the compressor inlet. In addition, an oil separator removes compressor oil from the superheated vapor refrigerant emerging from the compressor and returns the oil to the compressor through a return line. Condensed liquid refrigerant is provided to the recycling apparatus of the system by first passing through a second or recirculation filter/dryer. The filtered liquid refrigerant, from which non-condensable gas has been effectively removed by agitation in the filter/dryer, can then be supplied to an internal or external tank and recycled through a hand expansion valve which throttles the liquid refrigerant into a vapor phase over a continuous range.

U.S. Pat. No. 5,537,836 shows a refrigerant recovery unit including four distinct refrigerant flow paths automatically controlled to perform four separate and distinct functions. In a liquid refrigerant path, liquid refrigerant is recovered from the discharge side of an idle unit through the refrigerant recovery unit by use of the differential pressure between the disabled unit and the refrigerant receiving can. In a primary vapor path, evacuation of gaseous refrigerant from the high and low sides of the idle unit is achieved by use of a compressor in the recovery unit which produces a differential pressure to induce flow. This differential pressure is produced solely by the recovery unit compressor until such time as the intake pressure of the compressor reaches approximately 4 inches Hg. vacuum. When the compressor intake pressure reaches 4 inches Hg. vacuum, the system automatically switches to a secondary vapor path for recovering gaseous refrigerant from the high and low side of the idle unit by sequencing an external vacuum pump in series with the compressor of the recovery unit to produce the differential pressure inducing flow. This differential pressure is continued until the intake pressure reaches a desired vacuum level of up to 29.9 inches Hg. Finally, to recover gaseous refrigerant or non-condensible gas from the high and low side of the idle unit after the desired vacuum level has been reached, differential pressure is obtained by connecting the external vacuum pump through the recovery unit without using the compressor.

U.S. Pat. No. 5,671,605 relates to a refrigerant recovery system for recovering refrigerant from a cooling system. An oil separator separates oil from refrigerant before the refrigerant is drawn into the compressor. The oil separator has a helical coil disposed in a heat exchange relationship with the oil separator for receiving the refrigerant after the refrigerant is compressed by the compressor to cool the refrigerant. A condenser coil is also provided for receiving the refrigerant after the refrigerant has passed through the helical coil to further cool the refrigerant causing the refrigerant to condense.

U.S. Pat. No. 5,582,023 discloses a portable apparatus for recovering refrigerant from a refrigeration system and delivering the refrigerant to a refrigerant storage tank. The apparatus includes a liquid sensing thermistor in contact with the refrigerant entering the recovery machine. When liquid is detected, the refrigerant is routed directly to the recovery tank. Gaseous refrigerant and any non-condensable gases from the top of the recovery tank are directed to the suction of a compressor and then to a condenser and to a purge vessel that functions as a receiver. When the entering refrigerant is in a gaseous phase, the refrigerant is routed to the suction of the compressor. A second liquid sensing thermistor is in contact with the gaseous refrigerant from the top of the recovery tank and if liquid is detected the recovery process is terminated. A liquid sensing device near the bottom of the purge vessel actuates a solenoid valve to return the condensed liquid to the liquid inlet of the recovery tank. A cooling coil at the interior top of the purge vessel also condenses refrigerant. When non-condensable gases accumulate around the coil, there is less latent heat input to the coil and the suction line temperature drops. A temperature control with the sensing bulb at the suction line at a preset point actuates a solenoid valve in a line from the top of the purge vessel to purge the non-condensable gas through a small orifice to the atmosphere.

U.S. Pat. No. 5,597,533 shows an apparatus to sample and analyse refrigerant for purposes of refrigerant recovery and reuse including a refrigerant cell having a chamber for containing a refrigerant sample and a passage for connecting the chamber to a source of refrigerant in vapor phase. The sample chamber and passage are evacuated, and the chamber and at least a portion of the passage contiguous with the chamber are cooled until the temperature thereof reaches a predetermined temperature at or below ambient temperature. After the chamber and passage have been evacuated and cooled, the passage is connected to a source of refrigerant in vapor phase such that a refrigerant vapor sample is drawn into the chamber and condensed to liquid phase. After the cell chamber has been filled with a liquid refrigerant sample, one or more desired properties of the liquid refrigerant sample are measured or detected.

U.S. Pat. No. 5,533,345 and U.S. Pat. No. 5,537,835 disclose a system for transferring a refrigerant from a first refrigerant vessel having at least one refrigerant port to a second refrigerant vessel having at least one refrigerant port. This system includes a condenser, a pump assembly having an inlet and an outlet and conduits for operatively connecting the condenser and pump assembly to the first and second refrigerant vessel in several configurations. The pump assembly includes two pumps operated by one motor and interconnected to either provide series or parallel pumping. This system may also include a transfer tank interposed between the first and second refrigerant vessels. The transfer tank can be used to condense the vapor phase of the refrigerant removed from the first refrigerant vessel and collect the condensed refrigerant in one configuration, then to transfer the condensed refrigerant to the second refrigerant vessel in an alternate configuration. Methods employing this apparatus for transferring a refrigerant between a first refrigerant vessel and a second refrigerant vessel, optionally through a separate transfer tank, are also disclosed.

Despite these efforts to provide efficient, cost effective refrigerant recovery devices there remains a need for a rapid affordable refrigerant recovery system.

SUMMARY OF THE INVENTION

The present invention relates to a refrigerant recovery system for use in combination with a low pressure recovery reservoir to recover refrigerants such as CFC, HCFC and HFC from an air conditioning or refrigeration system.

The refrigerant recovery system comprises a system control to selectively control the operating configuration of the refrigerant recovery system to control the operation of the refrigerant recovery system in a plurality of operating modes, a refrigerant processor to selectively process the refrigerant circulated therethrough, a fluid conduit network including a plurality of liquid and/or vapor conduits to circulate refrigerant to and from the low pressure recovery reservoir and the air conditioning or refrigeration system and through the refrigerant processor, and a fluid flow control means including a plurality of fluid flow control devices or valves selectively operable in a first or open position and a second or closed position to selectively control the circulation of refrigerant through the fluid conduit network in one of the plurality of operating modes or configurations as described more fully hereinafter.

The low pressure recovery reservoir comprises a recovery tank including a liquid refrigerant recovery flow control device or valve and a vapor refrigerant recovery flow control device or valve to selectively control the flow of refrigerant therethrough.

The air conditioning or refrigeration system comprises a evaporator including a liquid refrigerant flow control device or value to selectively control the flow of refrigerant therethrough and a condenser including a vapor refrigerant flow control device or valve to selectively control the flow of refrigerant therethrough.

The system control comprises a microprocessor and a plurality of system sensors to monitor a corresponding plurality of system operating parameters and to feed signals corresponding to the state or magnitude of the individual system operating parameters thereto. Specifically, the plurality of system sensors includes a pressure sensor to sense or monitor the pressure within the evaporator and to generate a pressure signal in response thereto which is fed to the microprocessor and a recovery pressure sensor to sense or monitor the pressure within the recovery tank and to generate a recovery pressure signal in response thereto which is fed to the microprocessor. The microprocessor includes logic means to compare the pressure with the recovery tank pressure and to generate system control signals in response thereto as described more fully hereinafter.

The refrigerant processor comprises a compressor means and a processor condenser means.

In a typical application, the refrigerant recovery system is coupled between an air conditioning or refrigeration system and a low pressure recovery reservoir by a plurality of vapor and liquid hoses. Initially, refrigerant distribution will begin to equalize throughout the refrigerant recovery system and flow toward the recovery tank.

After a first predetermined period of time of equalization, the microprocessor sends control signals to the fluid flow control devices or valves to circulate refrigerant from the recovery tank of the low pressure recovery reservoir through the refrigerant processor to the condenser of the air conditioning or refrigeration system. This causes the pressure in the recovery tank to decrease and the pressure in the air conditioning or refrigeration system to increase. The refrigerant recovery system will continue to operate in the pressurization mode until a predetermined pressure differential between the recovery tank and the condenser is created.

When the predetermined pressure differential is created between the evaporator and the recovery tank, the microprocessor reconfigures the refrigerant recovery system from the pressurization mode to the liquid refrigerant recovery mode where liquid refrigerant travels from the evaporator through the fluid conduit network into the recovery tank.

Once the liquid is transferred from the evaporator to the recovery tank, the microprocessor will reconfigure the refrigerant recovery system into the vapor recovery configuration for operation in the vapor recovery mode where vapor is drawn from the condenser through the fluid conduit network through the refrigerant processor to condense the refrigerant and thence through the fluid conduit network to the recovery tank. Once the vapor refrigerant recovery is completed, the microprocessor shuts down the refrigerant recovery system.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
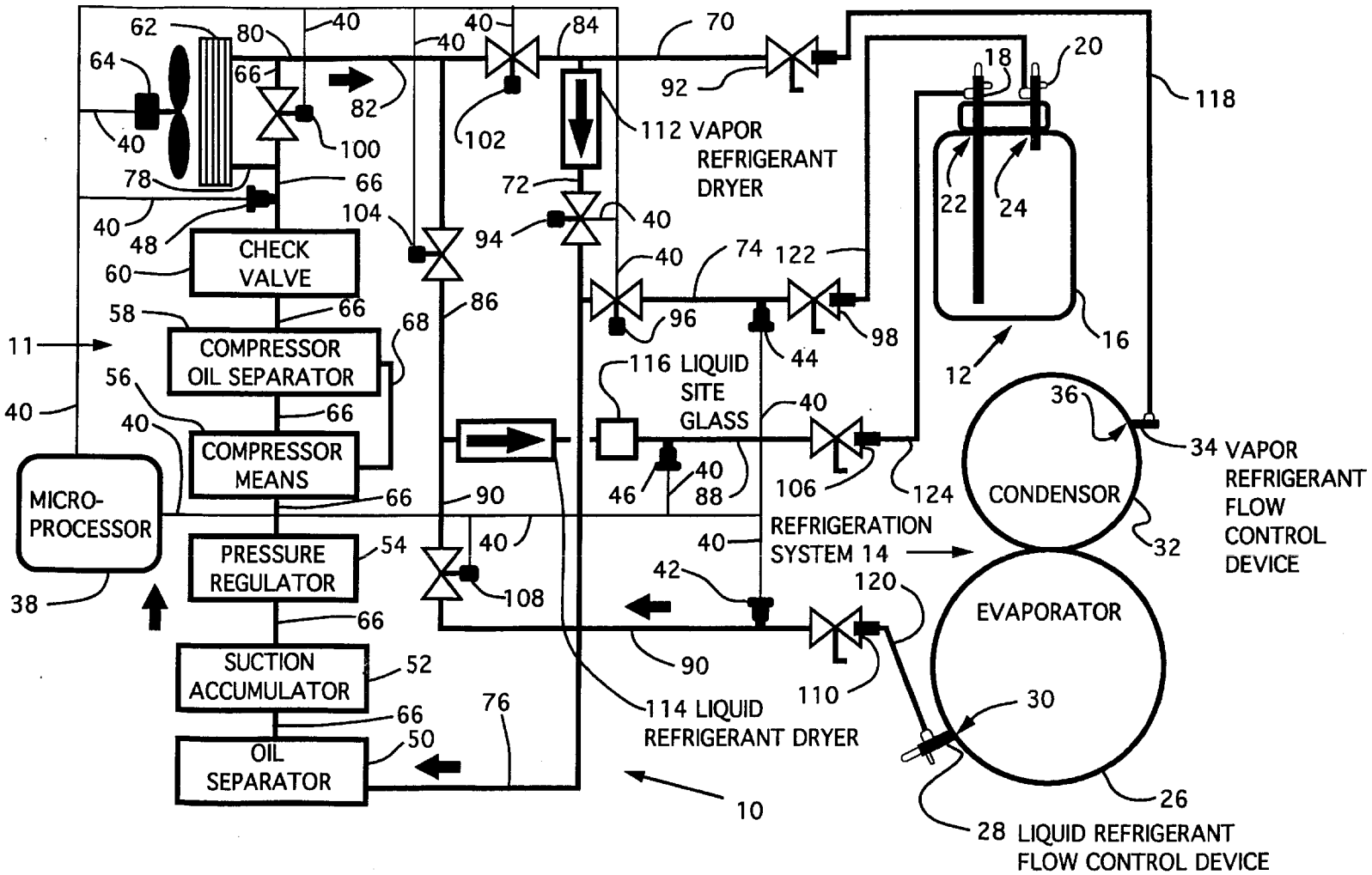
FIG. 1 is a schematic view of the refrigerant recovery system of the present invention in combination with a low pressure recovery tank and a high pressure air conditioning chiller.

As shown in FIG. 1, the present invention relates to a refrigerant recovery system generally indicated as 10 for use in combination with a low pressure recovery reservoir generally indicated as 12 to recover refrigerants such as CFC, HCFC and HFC from an air conditioning or refrigeration system such as indicated in 14.

The refrigerant recovery system 10 comprises a system control to selectively control the operating configuration of the refrigerant recovery system 10 to control the operation of the refrigerant recovery system 10 in a plurality of operating modes, a refrigerant processor 11 to selectively process the refrigerant circulated therethrough, a fluid conduit network including a plurality of liquid and/or vapor conduits to circulate refrigerant to and from the low pressure recovery reservoir 12 and the air conditioning or refrigeration system 14 and through the refrigerant processor 11, and a fluid flow control means including a plurality of fluid flow control devices or valves selectively operable in a first or open position and a second or closed position to selectively control the circulation of refrigerant through the fluid conduit network in one of the plurality of operating modes or configurations as described more fully hereinafter.

The low pressure recovery reservoir 12 comprises a recovery tank 16 including a liquid refrigerant recovery flow control device or valve 18 operable in an open and closed position and a vapor refrigerant recovery flow control device or valve 20 operable in an open and closed position disposed in operative relationship relative to a liquid recovery port 22 and a vapor recovery port 24 respectively to selectively control the flow of refrigerant therethrough.

The air conditioning or refrigeration system 14 comprises a evaporator 26 including a liquid refrigerant flow control device or value 28 operable in an open and closed position and disposed in operative relationship relative to a liquid feed port 30 to selectively control the flow of refrigerant therethrough and a condenser 32 including a vapor refrigerant flow control device or valve 34 operable in an open and closed position disposed in operative relationship relative to a vapor feed port 36 to selectively control the flow of refrigerant therethrough.

The system control comprises a microprocessor 38 and a plurality of system sensors operatively coupled thereto by a plurality of conductors or cables each indicated as 40 to monitor a corresponding plurality of system operating parameters and to feed signals corresponding to the state or magnitude of the individual system operating parameters thereto. Specifically, the plurality of system sensors includes a pressure sensor 42 to sense or monitor the pressure within the evaporator 26 and to generate a pressure signal in response thereto which is fed to the microprocessor 38 and a recovery pressure sensor 44 to sense or monitor the pressure within the recovery tank 16 and to generate a recovery pressure signal in response thereto which is fed to the microprocessor 38. The microprocessor 38 includes logic means to compare the pressure with the recovery tank pressure and to generate system control signals in response thereto as described more fully hereinafter. The plurality of system sensors may also include a liquid refrigerant sensor 46 and a safety pressure sensor 48 as described more fully hereinafter.

The refrigerant processor 11 includes means to selectively compress and condense the refrigerant. In particular, the refrigerant processor 11 comprises an oil separator 50, a suction accumulator 52, a pressure regulator 54, a compressor means 56, a compressor oil separator 58, a check valve 60 and a processor condenser means including a condenser 62 and a condenser fan 64 operatively coupled in series by a plurality of refrigerant processor conduits each indicated as 66. The compressor means 56 and the compressor oil separator 58 are operatively coupled by a separator oil feed back conduit 68. The compressor means 56 and the condenser fan 64 are coupled to the microprocessor 38 by the conductors or cables 40 to receive control signals therefrom as described more fully hereinafter.

The fluid conduit network comprises a vapor conduit including a first and second vapor conduit indicated as 70 and 72 respectively, a recovery tank vapor conduit 74, a processor vapor feed conduit 76, the plurality of refrigerant processor conduits 66, a processor condenser conduit including a processor condenser inlet conduit 78 and a processor condenser outlet conduit 80, a processor vapor/liquid outlet conduit 82, a processor vapor outlet conduit 84, a processor liquid outlet conduit 86, a recovery tank liquid conduit 88 and a liquid conduit 90.

The fluid flow control means comprises a first and second vapor flow control device or valve indicated as 92 and 94 respectively to selectively control the flow of vapor through the first vapor conduit 70 and the second vapor conduit 72 respectively, a first and second recover tank vapor flow control device or valve indicated as 96 and 98 respectively to selectively control the flow of vapor through the recovery tank vapor conduit 74, a refrigerant processor condenser flow control device or valve 100 to selectively control the flow of refrigerant through the refrigerant processor 11 and the condenser 62, a processor vapor flow control device or valve 102 to control the flow of vapor through the processor vapor outlet conduit 84, a processor liquid flow control device or valve 104 to selectively control the flow of refrigerant through the processor liquid outlet conduit 86, a recovery tank liquid control device or valve 106 to selectively control the flow of refrigerant through the recovery tank liquid conduit 88, and a first and second liquid flow control device or valve indicated as 108 and 110 respectively to selectively control the flow of refrigerant through the liquid conduit 90. As shown, various of the flow control device devices or valves are coupled to the microprocessor 38 by the conductors or cables 40.

A vapor refrigerant drier 112 is operatively coupled to the second vapor conduit 72 between the first vapor flow control device 92 and the second vapor flow control device 94; while, a liquid refrigerant drier 114 and a liquid site glass 116 are operatively coupled to the recovery tank liquid conduit 88 between the processor liquid flow control device or valve 104 and the first liquid flow control device or valve 108, and the recovery tank liquid flow control device or valve 106.

FIG. 1 shows a typical application in which the refrigerant recovery system 10 is connected between a air conditioning or refrigeration system 14 and a low pressure recovery reservoir 12. When operatively assembled, the vapor refrigerant flow control device or valve 34 and the first vapor flow control device or valve 92 are coupled by a vapor hose 118, and the liquid refrigerant flow control device or valve 28 and the second liquid flow control device or valve 110 are coupled by a liquid hose 120; while, the vapor refrigerant recover flow control device or valve 20 and the second recovery tank vapor flow control device or valve 98 are coupled by a recovery tank vapor hose 122, and the liquid refrigerant recovery flow control device or valve 18 and the recovery tank liquid flow control device or valve 106 are coupled by a recovery tank liquid hose 124. Initially, with liquid refrigerant recovery flow control device or valve 18, vapor refrigerant recovery flow control device or valve 20, liquid refrigerant flow control device or valve 28 and vapor refrigerant flow control device or valve 34, first vapor flow control device or valve 92, second recovery tank vapor flow control device or valve 98, recovery tank liquid flow control device or valve 106 and second liquid flow control device or valve 110 each in the open position, refrigerant distribution will begin to equalize throughout the refrigerant recovery system 10 and flow toward the recovery tank 16.

Figure 2:
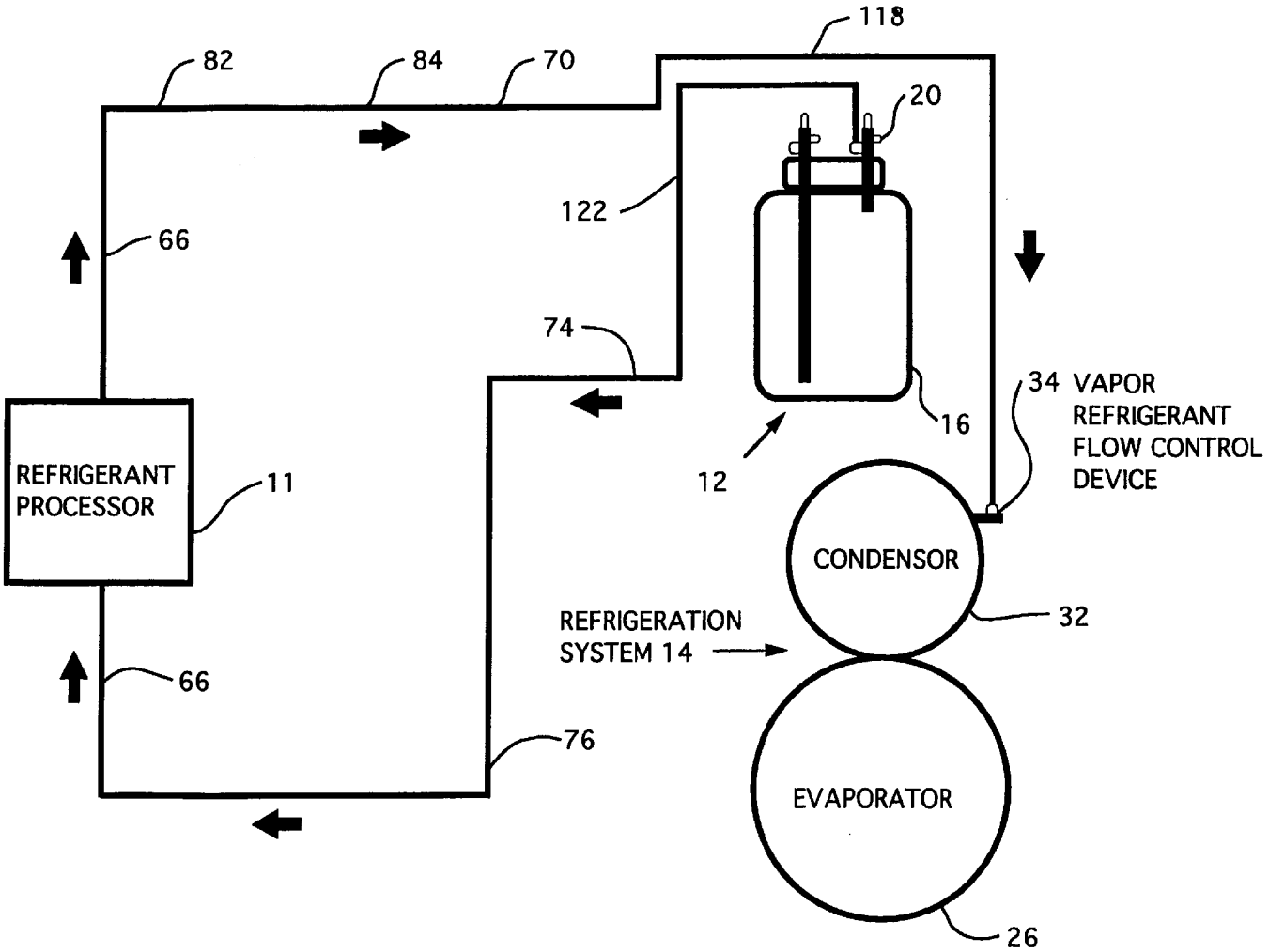
FIG. 2 is a diagrammatic view of the refrigerant recovery system of the present invention in the pressurization configuration.

After a first predetermined period of time of equalization such as approximately twenty seconds, the microprocessor 38 sends a control signal to close normally open processor vapor flow control device or valve 104, open normally closed processor vapor flow control device or valve 102, close normally open second vapor flow control device or valve 94 and turn on the compressor 56 such that the refrigerant recovery system 10 is in the pressurization configuration as shown in FIG. 2 to circulate refrigerant from the recovery tank 16 of the low pressure recovery reservoir 12 through the refrigerant processor 11 to the condenser 32 of the air conditioning or refrigeration system 14. Specifically, vapor refrigerant is drawn through recovery tank vapor hose 122, second recovery tank vapor flow control device or valve 98, recovery tank vapor conduit 74, first recovery tank vapor flow control device or valve 96 and processor vapor feed conduit 76 into the oil separator 50. The oil separator 50 separates oil from the vapor refrigerant being recovered. Refrigerant vapor then travels through the refrigerant conduit 66 into suction accumulator 52 which prevents liquid refrigerant from flowing to the compressor 56.

Refrigerant vapor then circulates through the refrigerant conduit 66 through pressure regulator 54 to ensure that pressure to the suction side of the compressor 56 does not overload the compressor 56 and into the compressor 54. The refrigerant vapor is then fed through the refrigerant conduit 66 into the compressor oil separator 58 where oil from the compressor 56 will be returned through feed back conduit 68.

The refrigerant vapor is fed through refrigerant conduit 66 and check valve 60 which prevents liquid from migrating back to the compressor 56 when the refrigerant recovery system 10 is equalizing or deenergized then past safety high pressure switch 48 coupled to the microprocessor 38 to protect against excessive head pressure and through normally open refrigerant processor condenser flow control device or valve 100, refrigerant conduit 66, processor vapor/liquid outlet conduit 82, open processor vapor flow control device or valve 102, first vapor conduit 70, first vapor flow control device or valve 92, vapor hose 118, vapor refrigerant flow control device or valve 34 into condenser 32. This causes the pressure in the recovery tank 16 to decrease and the pressure in the air conditioning or refrigeration system 14 to increase.

The refrigerant recovery system 10 will continue to operate the pressurization mode until a predetermined pressure differential such as 150 pounds per square inch between the recovery tank 16 and the condenser 32 is created. This is accomplished by the microprocessor controller 38 comparing the recovery tank pressure sensed by the recovery pressure sensor 44 with the evaporator liquid pressure sensed by the pressure sensor 42. Although the recovery pressure sensor 44 is shown in operative relationship relative to the recovery tank vapor conduit 74, the recovery pressure sensor 44 can be operatively coupled to the recovery tank liquid conduit 88.

Figure 3:
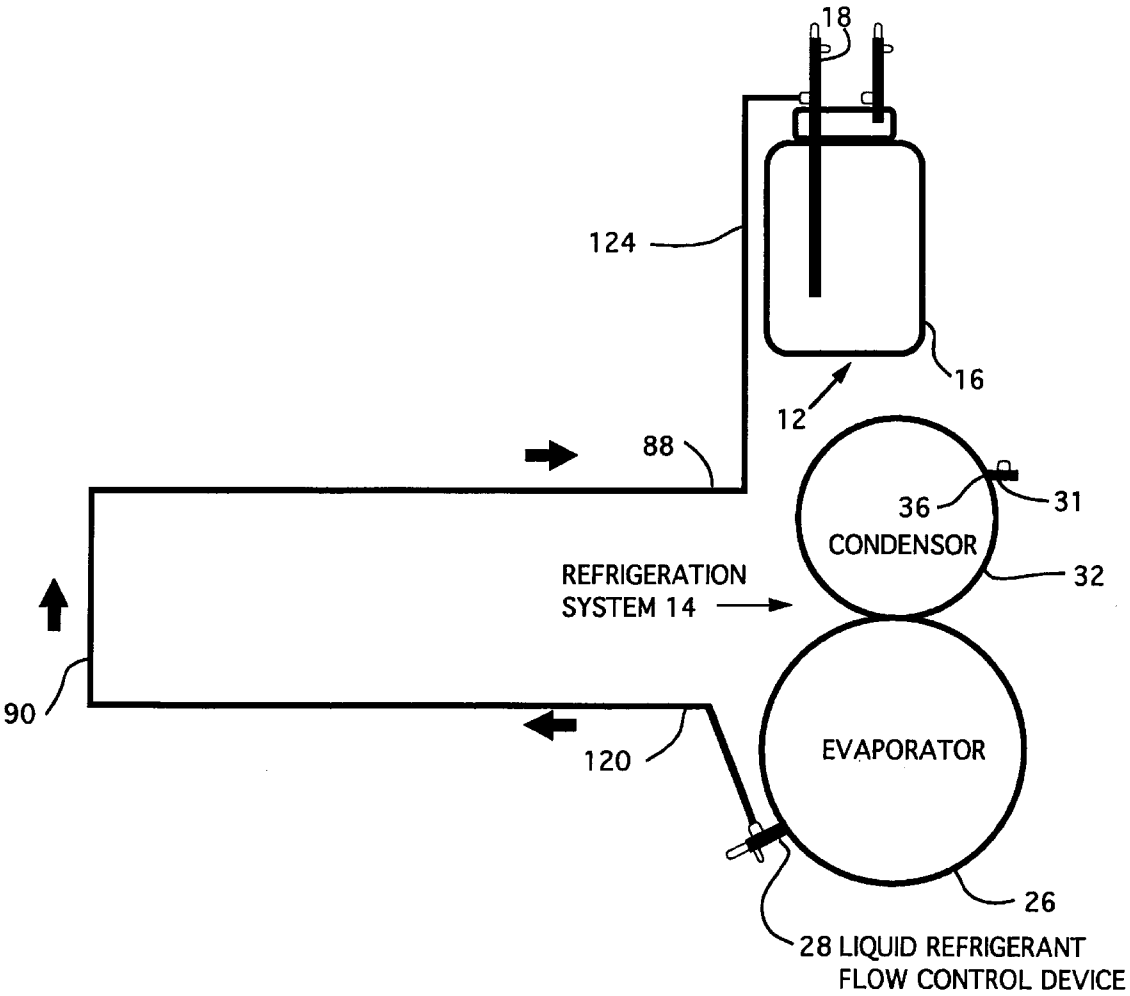
FIG. 3 is a diagrammatic view of the refrigerant recovery system of the present invention in the liquid recovery configuration.

When a pressure differential of 150 pounds per square inch is created between the evaporator 26 and the recovery tank 16, the microprocessor 38 will reconfigure the refrigerant recovery system 10 into the liquid recovery configuration as shown in FIG. 3 to operate in the liquid recovery mode. Specifically, the microprocessor 38 opens the first liquid flow control device or valve 108. When so configured, liquid refrigerant travels from evaporator 26 through liquid refrigerant flow control device or valve 28, liquid refrigerant hose 120, second liquid flow control device or valve 110, liquid conduit 90 past pressure sensor 42, through first liquid flow control device or valve 108 into liquid refrigerant drier 114. The liquid refrigerant drier 114 removes any particulates, moisture and debris from the liquid refrigerant. Liquid refrigerant then flows through liquid site glass 116 through recovery tank liquid conduit 88 past liquid refrigerant sensor 46 and recovery pressure sensor 44 through recovery tank liquid flow control device or valve 106, recovery tank liquid hose 124 and liquid refrigerant recovery flow control device or valve 18 and into recovery tank 16 of the low pressure recovery reservoir 12. Liquid will continue to flow until virtually all the liquid is removed from evaporator 26.

Figure 4:
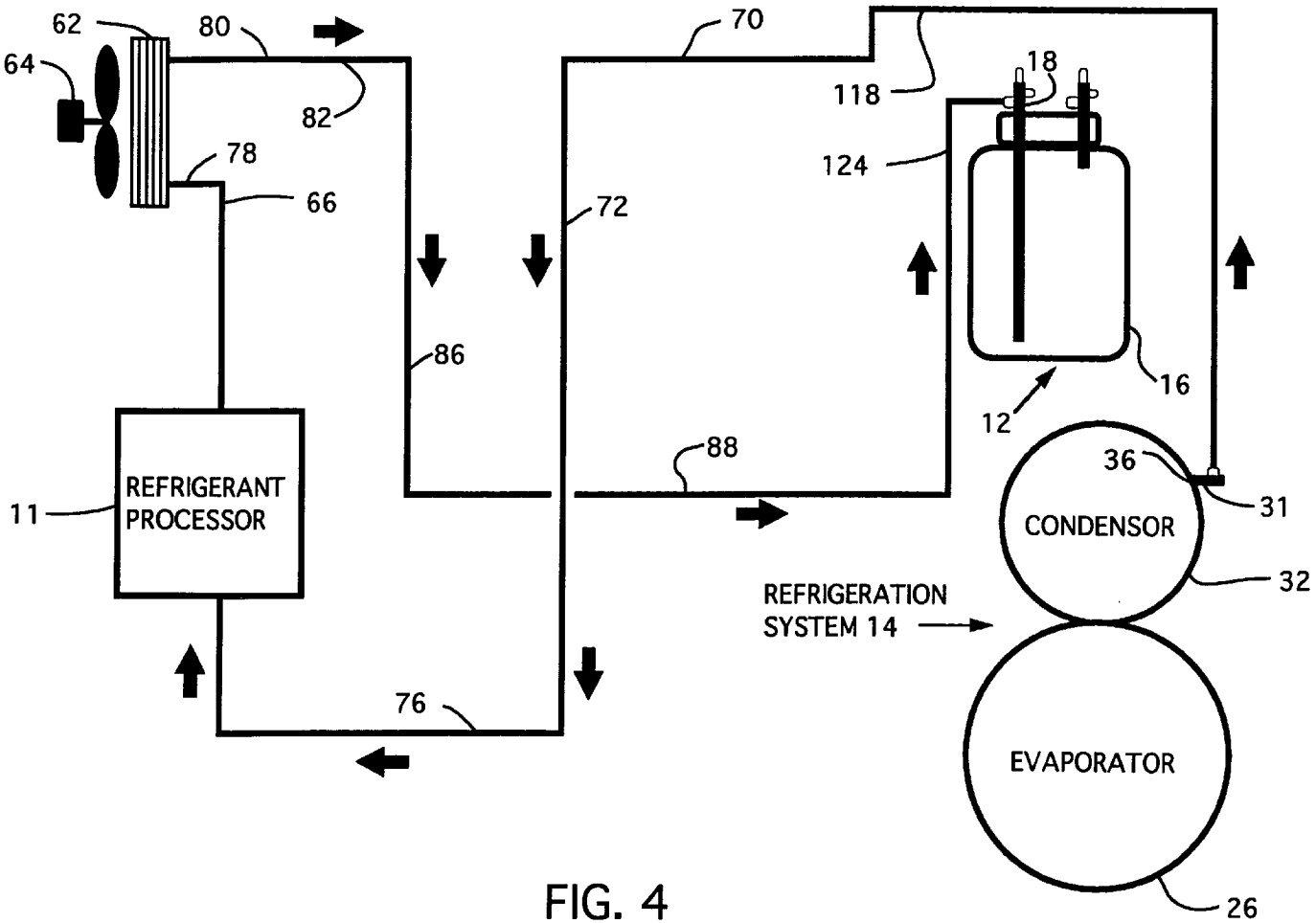
FIG. 4 is a diagrammatic view of the refrigerant recovery system of the present invention in the vapor recovery configuration.

Once the liquid refrigerant sensor 46 senses that liquid is no longer being fed from the evaporator 26 to the recovery tank 16, the microprocessor 38 will generate control signals to reconfigure the refrigerant recovery system 10 into the vapor recovery mode or configuration as shown in FIG. 4. Specifically, the microprocessor 38 closes first liquid flow control device or valve 108, opens processor vapor flow control device or valve 104, closes processor vapor flow control device or valve 102, opens second vapor flow control device or valve 94, closes valve 96, closes refrigerant processor condenser flow control device or valve 100 and activates the condensing fan 64 with the compressor 56 activated. Vapor pressure from the air conditioning or refrigeration system 14 is continuously monitored by the pressure sensor 42.

When operating in the vapor recovery mode, vapor refrigerant is drawn from condenser 32 through vapor refrigerant flow control device or valve 34, vapor hose 118, first vapor flow control device or valve 92, first vapor conduit 70, vapor refrigerant drier 112, second vapor conduit 72, second vapor flow control device or valve 94, processor vapor feed conduit 76, oil separator 50, refrigerant conduit 66, pressure regulator 54, refrigerant conduit 66, pressure regulator 54, refrigerant conduit 66, compressor 56, where refrigerant vapor is compressed. The refrigerant vapor then travels through the refrigerant conduit 66 into the compressor oil separator 58, where any oil lost from the compressor 56 will be returned through the feed back conduit 68. The refrigerant vapor leaving the oil separator 58 circulates through refrigerant conduit 66, and check valve 60 past safety high pressure switch 48 through refrigerant conduit 66 and first vapor conduit 70, into condenser 62 where the refrigerant vapor is condensed into a liquid refrigerant.

Then, condensed liquid refrigerant flows through processor condenser outlet conduit 80, processor vapor/liquid outlet conduit 82, processor vapor flow control device or valve 104 through processor liquid outlet conduit 86, liquid refrigerant drier 114, site glass 116 then past liquid sensor 46, through recovery tank liquid conduit 88 past pressure sensor 44 through recovery tank liquid flow control device or valve 106 through refrigerant hose 124 through liquid refrigerant recovery flow control device or valve 18 and finally into the recovery tank 16.

The vapor recovery mode will continue until all of the refrigerant has been recovered from the air conditioning or refrigeration system 14 and a 15 Hg vacuum has been achieved. The vapor recovery averages about 7 to 10 pounds of refrigerant per minute. Once the vapor recovery is completed the microprocessor 38 shuts down the refrigerant recovery system 10.

Once the refrigerant recovery system 10 is shut down, liquid refrigerant remaining in the recovery tank liquid hose 124 can be drawn into the refrigerant recovery system 10. This is accomplished by closing liquid refrigerant recovery flow control device or valve 18, liquid feed port 30, vapor feed port 36, first vapor flow control device or valve 92, second recovery tank vapor flow control device or valve 98, and second liquid flow control device or valve 110 and opening the processor vapor flow control device or valve 102. The reason liquid refrigerant from recovery tank liquid hose 124 can be evacuated and drawn back into the recovery apparatus is because there is a vacuum at processor vapor flow control device or valve 102 which occurs only when vapor recovery is complete.

Once complete, then the recovery tank liquid flow control device or valve 106 is closed.

All the above sequences are fully automatic and will ensure rapid recovery of all types of CFC, HCFC, and HFC refrigerants.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A refrigerant recovery system for use in combination with a low pressure recovery reservoir to recover refrigerant from an evaporator and a condenser selectively operable in a plurality of system operating modes including a pressurized mode, a liquid refrigerant recovery mode and a vapor refrigerant recovery mode comprising a system control including a microprocessor to control the operation of the refrigerant recovery system and a plurality of control sensors to monitor a corresponding plurality of system operating parameters, a refrigerant processor operatively coupled to the low pressure recovery tank and the evaporator and the condenser by a fluid flow conduit network including a plurality of fluid conduit branches and a fluid flow control including a plurality of fluid flow control devices coupled to said microprocessor to receive control signals therefrom and operatively disposed relative to said fluid conduit network to selectively configure said fluid conduit network to control the flow of the refrigerant therethrough in a plurality of operating configurations corresponding to said plurality of system operating modes in response to the state of said plurality of system operating parameters sensed by said plurality of control sensors to transfer refrigerant from the evaporator and the condenser to the low pressure recovery reservoir, the low pressure recovery reservoir comprises a recovery tank including a liquid refrigerant recovery flow control device and a vapor refrigerant recovery flow control device to selectively control the flow of refrigerant therethrough, the evaporator includes a liquid refrigerant flow control device to selectively control the flow of refrigerant therethrough and the condenser includes a vapor refrigerant flow control device to selectively control the flow of refrigerant therethrough and said refrigerant recovery system being coupled between the evaporator and the condenser and the low pressure recovery reservoir by a plurality of vapor and liquid hoses said plurality of system sensors including a pressure sensor to monitor the pressure within the evaporator and to generate an evaporator pressure signal in response thereto fed to said microprocessor and a recovery pressure sensor to monitor the pressure within the recovery tank and to generate a recovery tank pressure signal in response thereto fed to said microprocessor, said microprocessor including logic means to compare the evaporator pressure with the recovery tank pressure and to generate system control signals in response thereto whereby refrigerant distribution will begin to equalize throughout said refrigerant recovery system and flow toward the recovery tank and after a first predetermined period of time of equalization, said microprocessor sends control signals to said fluid flow control devices to circulate refrigerant from the recovery tank of the low pressure recovery reservoir through said refrigerant processor to the condenser and evaporator causing the pressure in the recovery tank to decrease and the pressure in the evaporator and the condenser to increase, said refrigerant recovery system will continue to operate in the pressurization mode until a predetermined pressure differential between the recovery tank and said condenser is created, when said predetermined pressure differential is created between the evaporator and the recovery tank said microprocessor reconfigures said refrigerant recovery system from said pressurization mode to said liquid refrigerant recovery mode where liquid refrigerant travels from the evaporator through said fluid conduit network into the recovery tank where the liquid is transferred from the evaporator to the recovery tank, said microprocessor will reconfigure said refrigerant recovery system into said vapor recovery configuration when the liquid refrigerant is transferred from the evaporator to the recovery tank for operation in said vapor recovery mode where vapor is drawn from the condenser through said fluid conduit network through said refrigerant processor to condense the refrigerant and thence through said fluid conduit network to the recovery tank the vapor refrigerant recovery is completed.

2. The refrigerant recovery system of claim 1 wherein after a first predetermined period of time of equalization said microprocessor will generate control signals to reconfigure said refrigerant recovery system to said pressurization mode.

3. The refrigerant recovery system of claim 2 wherein said microprocessor sends a control signal to close normally open processor vapor flow control device, open normally closed processor vapor flow control device close normally, open second vapor flow control device and turn on the compressor such that the refrigerant recovery system is said pressurization configuration circulate refrigerant from the recovery tank of the low pressure recovery reservoir through said refrigerant processor to the condenser of the evaporator and the condenser.

4. The refrigerant recovery system of claim 2 wherein said refrigerant recovery system will continue to operate in said pressurization mode until a predetermined pressure differential between the recovery tank and the evaporator is created and wherein said microprocessor controller compares the recovery tank pressure sensed by a recovery pressure sensor with the evaporator liquid pressure sensed by a pressure sensor.

5. The refrigerant recovery system of claim 4 wherein said microprocessor will reconfigure said refrigerant recovery system into said liquid recovery configuration to operate in said liquid recovery mode when said predetermined pressure differential is reached.

6. The refrigerant recovery system of claim 5 wherein said microprocessor will generate control signals to reconfigure said refrigerant recovery system to said vapor recovery mode when liquid refrigerant is exhausted from the evaporator.

7. The refrigerant recovery system of claim 6 wherein said vapor recovery configuration is created when microprocessor closes first liquid flow control device, opens processor vapor flow control device, closes processor vapor flow control device, opens second vapor flow control device, closes first recovery tank vapor flow control device, closed refrigerant processor condenser flow control device and activates the condensing fan with the compressor activated to feed refrigerant from the condenser to the recovery tank.

8. A refrigerant recovery system for use in combination with a low pressure recovery reservoir to recover refrigerants from an evaporator and a condenser selectively operable in a plurality of system operating modes including a pressurization mode, a liquid refrigerant recovery mode and a vapor refrigerant recovery mode comprising a system control including a microprocessor to control the operation of the refrigerant recovery system and a plurality of control sensors to monitor a corresponding plurality of system operating parameters, a refrigerant processor operatively coupled to the low pressure recovery tank and the evaporator and the condenser by a fluid flow conduit network including a plurality of fluid conduit branches and a fluid flow control including a plurality of fluid flow control devices coupled to said microprocessor to receive control signals therefrom and operatively disposed relative to said fluid conduit network to selectively configure said fluid conduit network to control the flow of the refrigerant therethrough in a plurality of operating configurations corresponding to said plurality of system operating modes in response to the state of said plurality of system operating parameters sensed by said plurality of control sensors to transfer refrigerant from the evaporator and the condenser to the low pressure recovery reservoir, the low pressure recovery reservoir comprises a recovery tank including a liquid refrigerant recovery flow control device operable in an open and closed position and a vapor refrigerant recovery flow control device operable in an open and closed position to selectively control the flow of refrigerant therethrough, the evaporator includes a liquid refrigerant flow control device operable in an open and closed position and disposed in operative relationship relative to a liquid feed port to selectively control the flow of refrigerant therethrough and the condenser including a vapor refrigerant flow control device operable in an open and closed position disposed in operative relationship relative to a vapor feed port to selectively control the flow of refrigerant therethrough, said plurality of system sensors includes a pressure sensor to monitor the pressure within the evaporator and to generate an evaporator pressure signal in response thereto which is fed to said microprocessor and a recovery pressure sensor to monitor the pressure within the recovery tank and to generate a recovery tank pressure signal in response thereto which is fed to said microprocessor, said microprocessor includes logic means to compare the evaporator pressure with the recovery tank pressure and to generate system control signals in response thereto, said refrigerant processor includes means to selectively compress and condense the refrigerant operatively coupled by a plurality of refrigerant processor conduits, said fluid conduit network comprises a vapor conduit including a first and second vapor conduit, a recovery tank vapor conduit, a processor vapor feed conduit, said plurality of refrigerant processor conduits, a processor condenser conduit including a processor condenser inlet conduit and a processor condenser outlet conduit, a processor vapor/liquid outlet conduit a processor vapor outlet conduit, a processor liquid outlet conduit, a recovery tank liquid conduit, and a liquid conduit, said fluid flow control means comprises a first and a second vapor flow control device to selectively control the flow of vapor through said first vapor conduit and said vapor conduit respectively, a first and second recover tank vapor flow control device to selectively control the flow of vapor through said recovery tank vapor conduit a refrigerant processor condenser flow control device to selectively control the flow of refrigerant through said refrigerant processor and the condenser, a processor vapor flow control device to control the flow of vapor through said processor vapor outlet conduit a processor liquid flow control device to selectively control the flow of refrigerant through said processor liquid outlet conduit, a recovery tank liquid control device to selectively control the flow of refrigerant through the recovery tank liquid conduit and a first and second liquid flow control device to selectively control the flow of refrigerant through said liquid conduit, said flow control device devices being coupled to said microprocessor by a plurality of conductors.

* * * * *